US009970258B2

(12) United States Patent
Barannikow et al.

(10) Patent No.: US 9,970,258 B2
(45) Date of Patent: May 15, 2018

(54) REMOTELY OPERATED STAGE CEMENTING METHODS FOR LINER DRILLING INSTALLATIONS

(71) Applicant: Weatherford Technology Holdings, LLC

(72) Inventors: Ivan Andre Barannikow, Houma, LA (US); Douglas Brian Farley, Missouri City, TX (US); Egor Dudochkin, Conroe, TX (US); Steven Michael Rosenberg, Cypress, TX (US); Bjørn Erling Hagen, Stavanger (NO); Richard Alastair Howard Dalzell, Kirriemuir (GB)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 279 days.

(21) Appl. No.: 14/710,086

(22) Filed: May 12, 2015

(65) Prior Publication Data

US 2015/0330180 A1 Nov. 19, 2015

Related U.S. Application Data

(60) Provisional application No. 61/994,629, filed on May 16, 2014.

(51) Int. Cl.
*E21B 33/14* (2006.01)
*E21B 33/12* (2006.01)
(Continued)

(52) U.S. Cl.
CPC ..... *E21B 33/146* (2013.01); *E21B 33/12* (2013.01); *E21B 33/14* (2013.01); *E21B 34/066* (2013.01); *E21B 34/10* (2013.01)

(58) Field of Classification Search
CPC ..... E21B 33/146; E21B 33/12; E21B 34/066; E21B 34/10; E21B 33/14
See application file for complete search history.

(56) References Cited

U.S. PATENT DOCUMENTS 2,187,483 A 1/1940 Baker
3,528,686 A 9/1970 Nelson
(Continued)

FOREIGN PATENT DOCUMENTS

WO 2013/103785 A2 7/2013

OTHER PUBLICATIONS

Schlumberger Oilfield Glossary entries for "liner", "liner hanger" and "casing hanger", accessed Jun. 6, 2017 via www.glossary.oilfield.slb.com.*

(Continued)

*Primary Examiner* — Blake E Michener
(74) *Attorney, Agent, or Firm* — Patterson & Sheridan, L.L.P.

(57) ABSTRACT

A method of using a liner assembly comprises inserting the liner assembly into a wellbore, the liner assembly having an annular packer and a port collar. The method further comprises closing fluid flow through a lower end of the liner assembly, actuating the annular packer into engagement with the wellbore, and actuating the port collar into an open position to open fluid communication between an interior of the liner assembly and the wellbore. The method further comprises pumping cement into the wellbore through the port collar at a location above the annular packer and actuating the port collar into a closed position to close fluid communication between the interior of the liner assembly and the wellbore.

25 Claims, 16 Drawing Sheets

(51) Int. Cl.
*E21B 34/06* (2006.01)
*E21B 34/10* (2006.01)

(56) References Cited

U.S. PATENT DOCUMENTS

| | | | | |
|---|---|---|---|---|
| 3,948,322 | A | 4/1976 | Baker | |
| 4,286,658 | A | 9/1981 | Baker et al. | |
| 4,333,530 | A | 6/1982 | Armstrong | |
| 4,751,967 | A | 6/1988 | Blandford et al. | |
| 4,848,459 | A | 7/1989 | Blackwell et al. | |
| 4,854,386 | A * | 8/1989 | Baker | E21B 33/16 166/123 |
| 4,869,323 | A | 9/1989 | Stagg | |
| 5,279,370 | A * | 1/1994 | Brandell | E21B 33/128 166/184 |
| 5,299,640 | A | 4/1994 | Streich et al. | |
| 5,348,089 | A | 9/1994 | Brandell et al. | |
| 5,443,124 | A | 8/1995 | Wood et al. | |
| 6,443,247 | B1 | 9/2002 | Wardley | |
| 6,866,100 | B2 | 3/2005 | Gudmestad et al. | |
| 6,920,930 | B2 | 7/2005 | Allamon et al. | |
| 7,234,546 | B2 | 6/2007 | Vincent et al. | |
| 7,252,152 | B2 | 8/2007 | LoGiudice et al. | |
| 7,311,148 | B2 | 12/2007 | Giroux et al. | |
| 7,857,052 | B2 * | 12/2010 | Giroux | E21B 7/20 166/154 |
| 2004/0011521 | A1 * | 1/2004 | Collins | E21B 41/0035 166/177.4 |
| 2004/0094309 | A1 | 5/2004 | Maguire | |
| 2004/0144567 | A1 | 7/2004 | Boyd | |
| 2007/0261850 | A1 * | 11/2007 | Giroux | E21B 7/20 166/291 |
| 2010/0051276 | A1 * | 3/2010 | Rogers | E21B 33/146 166/289 |
| 2010/0163253 | A1 * | 7/2010 | Caldwell | E21B 33/146 166/387 |
| 2012/0241154 | A1 * | 9/2012 | Zhou | E21B 33/146 166/285 |
| 2012/0261127 | A1 * | 10/2012 | Zhou | E21B 21/103 166/289 |
| 2013/0161101 | A1 | 6/2013 | Zhou | |
| 2013/0233572 | A1 * | 9/2013 | Helms | E21B 33/146 166/387 |
| 2014/0118613 | A1 | 5/2014 | Chang et al. | |
| 2014/0299334 | A1 | 10/2014 | Hallundbaeck et al. | |
| 2016/0024877 | A1 * | 1/2016 | Coronado | E21B 33/16 166/177.4 |

OTHER PUBLICATIONS

American Heritage Dictionary definition of "swivel", accessed Nov. 21, 2017 via ahdictionary.com.*

Canadian Office Action dated Apr. 22, 2016, for Canadian Patent Application No. 2,891,579.

United Kingdom Examination Report dated Apr. 11, 2017, for Application No. GB1508335.5.

UK Search Report dated Mar. 23, 2016, for UK Patent Application No. GB1508335.5.

UK Examination Report dated Mar. 23, 2016, for UK Patent Application No. GB1508335.5.

Weatherford, "Weatherford Premium Hydraulic-Rotating (WPHR) Liner Hanger", 2006-2011, pp. 1-2.

Weatherford, "Premium Hydraulic Rotating (PHR) Liner Hanger", 2006, 2 Pgs.

Weatherford, "Weatherford's Liner Systems Hang Tough", 2008, pp. 1-20.

Weatherford, "R Running Tool with Hydraulically Released Mechanical Lock", 2006, 2 Pgs.

United Kingdom Examination Report dated May 11, 2017, for Patent Application No. GB1508336.3.

Canadian Office Action dated Jul. 7, 2016, corresponding to Application No. 2,891,570.

Canadian Office Action dated Jul. 5, 2017, corresponding to Application No. 2,891,570.

* cited by examiner

REMOTELY OPERATED STAGE CEMENTING METHODS FOR LINER DRILLING INSTALLATIONS

CROSS REFERENCE TO RELATED APPLICATIONS

This application claims benefit of U.S. Provisional Patent Application Ser. No. 61/994,629, filed May 16, 2014, the contents of which are incorporated herein by reference in their entirety.

BACKGROUND OF THE DISCLOSURE

Field

The embodiments described herein relate to a drilling liner assembly and method of use.

Description of the Related Art

A wellbore is formed by rotating and lowering a drill string, which has a drill bit connected at the lower end, into the earth. Drilling fluid is circulated into the wellbore while the wellbore is being drilled to remove the drilled earth and other wellbore debris. Drilling fluid is pumped down and out of the drill string into the wellbore, and flows back up to the surface through the annulus formed between the outer surface of the drill string and the inner surface of the wellbore, carrying out the drilled earth and other wellbore debris.

Sometimes, the wellbore is drilled into a low pressure zone, which causes the drilling fluid to flow into the low pressure zone and prevents removal of the drilled earth and other wellbore debris. The drilled earth and other wellbore debris that are not removed accumulate at the bottom of the wellbore and clog the annulus formed between the outer surface of the drill string and the inner surface of the wellbore, inhibiting further drilling of the wellbore. To isolate the low pressure zone, the drill string is removed and a liner string is lowered into the wellbore at a location above or adjacent to the low pressure zone.

Cement is pumped down and out of the liner string into the annulus formed between the outer surface of the liner string and the inner surface of the wellbore to cement the liner string in the wellbore and thereby isolate the low pressure zone. A drill string can then be lowered through the liner string to continue drilling the wellbore using another drilling fluid suitable for use in the low pressure zone. The separate liner string and cementing operations increase the time and costs of forming the wellbore.

Therefore, there is a continuous need for a new and improved wellbore drilling apparatus and methods.

SUMMARY OF THE INVENTION

In one embodiment, a method of using a liner assembly comprises inserting the liner assembly into a wellbore, wherein the liner assembly includes an annular packer and a port collar; closing fluid flow through a lower end of the liner assembly; actuating the annular packer into engagement with the wellbore; actuating the port collar into an open position to open fluid communication between an interior of the liner assembly and the wellbore, wherein the port collar is actuated into the open position after the annular packer is actuated into engagement with the wellbore; pumping cement into the wellbore through the port collar at a location above the annular packer; and actuating the port collar into a closed position to close fluid communication between the interior of the liner assembly and the wellbore.

In one embodiment, a method of using a liner assembly comprises lowering the liner assembly into a wellbore, wherein the liner assembly includes an annular packer, an upper port collar, and a lower port collar; actuating the annular packer into engagement with the wellbore; actuating one of the upper and lower port collars into an open position to open fluid communication between an interior of the liner assembly and the wellbore; pumping cement into the wellbore through the upper or lower port collar; and actuating the upper or lower port collar into a closed position to close fluid communication between the interior of the liner assembly and the wellbore.

In one embodiment, a liner assembly for use in a wellbore comprises a liner hanger; a liner packer positioned below the liner hanger; a port collar positioned below the liner packer, wherein the port collar is movable between an open position that opens fluid communication between an interior of the liner assembly and an annulus surrounding the liner assembly, and a closed position that closes fluid communication between the interior of the liner assembly and the annulus surrounding the liner assembly; and an annular packer positioned below the port collar, wherein the annular packer is configured to be actuated into engagement with the wellbore prior to the port collar being movable into the open position.

BRIEF DESCRIPTION OF THE DRAWINGS

So that the manner in which the above recited features can be understood in detail, a more particular description, briefly summarized above, may be had by reference to embodiments, some of which are illustrated in the appended drawings. It is to be noted, however, that the appended drawings illustrate only typical embodiments and are therefore not to be considered limiting of its scope, for the invention may admit to other equally effective embodiments.

DETAILED DESCRIPTION

FIGS. 1A, 1B, 1C, and 1D illustrate a method of drilling and lining a wellbore 2 using a drilling liner assembly 10, according to one embodiment. The liner assembly 10 can be used to drill the wellbore 2 and isolate a low pressure zone 6 in a single trip. In one embodiment, the liner assembly 10 can be inserted and lowered into a previously drilled wellbore 2. The liner assembly 10 comprises a liner string that can be suspended from the wall of the wellbore 2 and/or from a casing or liner string previously installed within the wellbore 2.

Figure 1D:
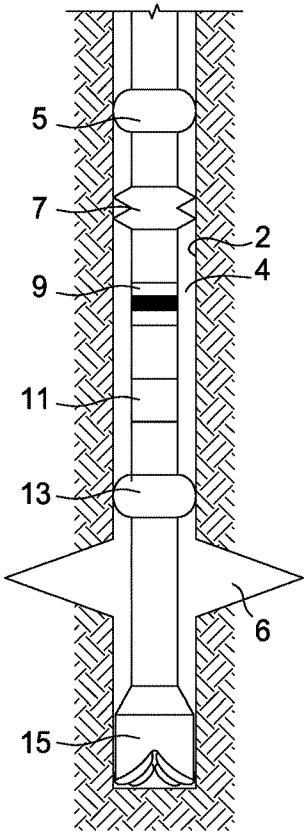
FIGS. 1A, 1B, 1C, and 1D illustrate a method of drilling and lining a wellbore according to one embodiment.
Figure 1C:
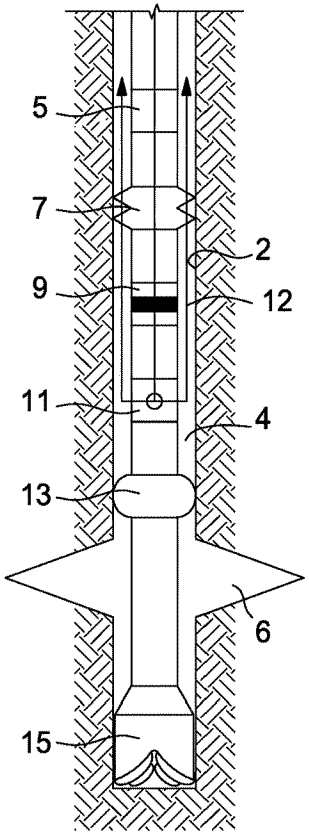
Figure 1B:
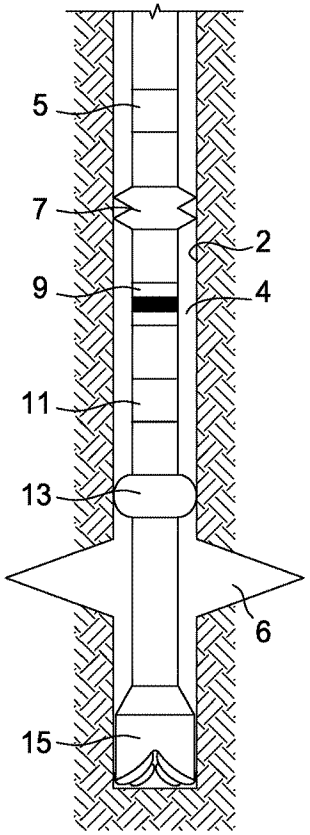
Figure 1A:
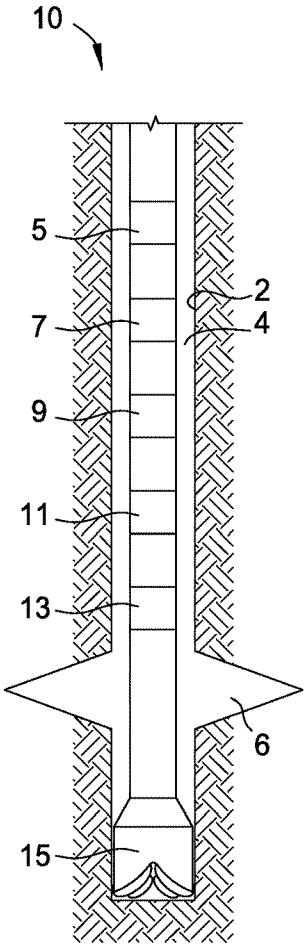

As illustrated in FIG. 1A, the liner assembly 10 includes a liner packer 5, a liner hanger 7, a swivel 9, a port collar 11, an annular packer 13, and a drill bit 15. The components of the liner assembly 10 can be coupled together directly or indirectly by one or more tubular members, such as pup joints. The liner assembly 10 is lowered and rotated by a running string (such as running string 100 illustrated in FIG. 2A) to rotate the drill bit 15 and drill the wellbore 2. In one embodiment, the liner assembly 10 may include a motor (such as a drilling motor powered by drilling fluid as known in the art) configured to rotate the drill bit 15 relative to the remainder of the liner assembly 10 so that the entire liner assembly 10 does not have to be rotated by the running string to drill the wellbore 2. The motor and drill bit 15 may be drilled through when the liner assembly 10 is cemented in place as further described below.

Drilling fluid is pumped down and out of the end of the liner assembly 10 into an annulus 4 formed between the outer surface of the liner assembly 10 and the inner surface of the wellbore 2. The drilling fluid is circulated back up to the surface through the annulus 4, carrying out drilled earth and other wellbore debris. The liner assembly 10 may continue to drill the wellbore 2 until the low pressure zone 6 is reached. In some situations, the drilling fluid may flow into the low pressure zone 6 such that circulation of the drilled earth and other wellbore debris back to the surface is stopped, which can prevent further rotation of the liner assembly 10 and/or the drill bit 15 and cause the liner assembly 10 to become stuck within the wellbore 2.

Figure 2A:
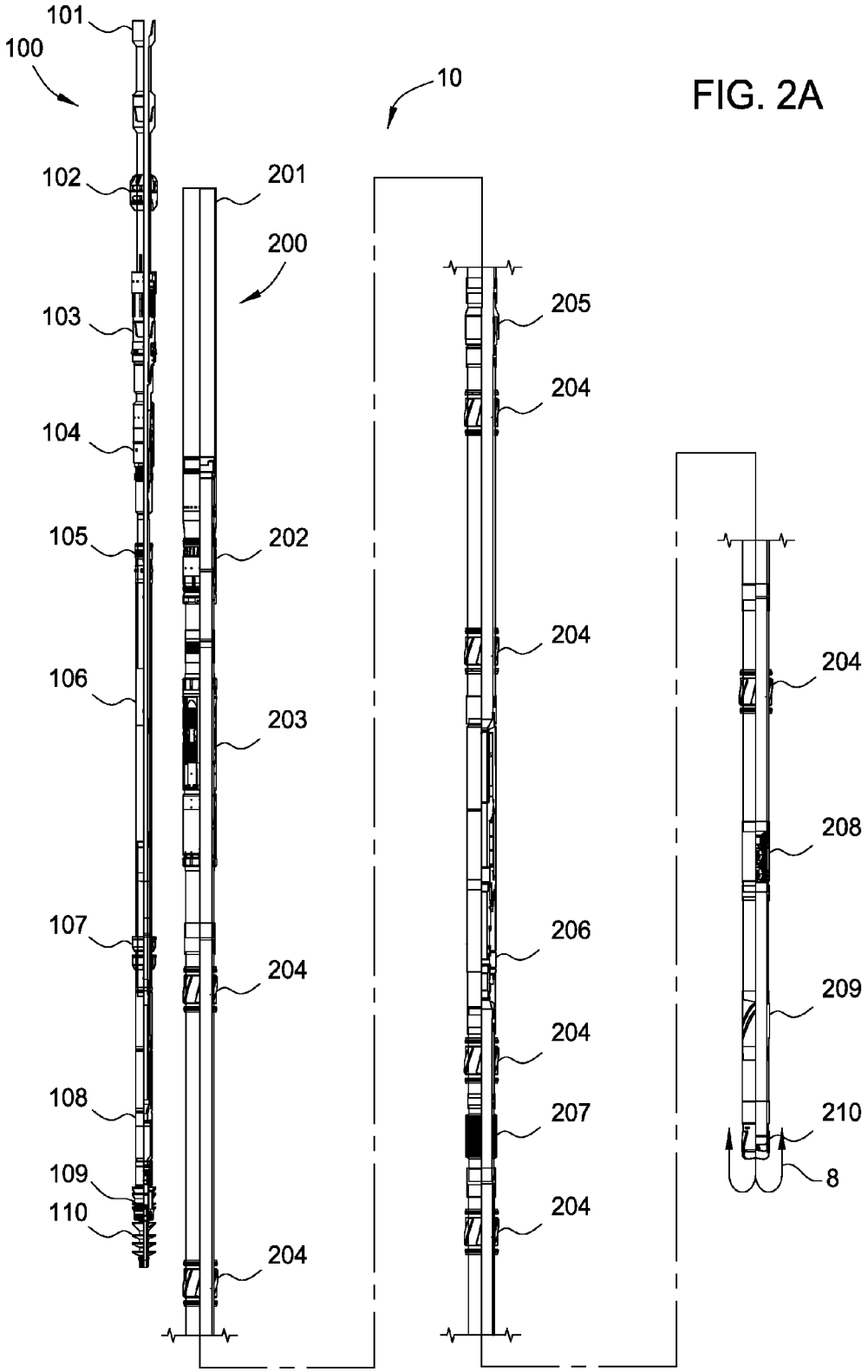
FIGS. 2A, 2B, 2C, 2D, 2E, and 2F illustrate a drilling liner assembly according to one embodiment.
Figure 2B:
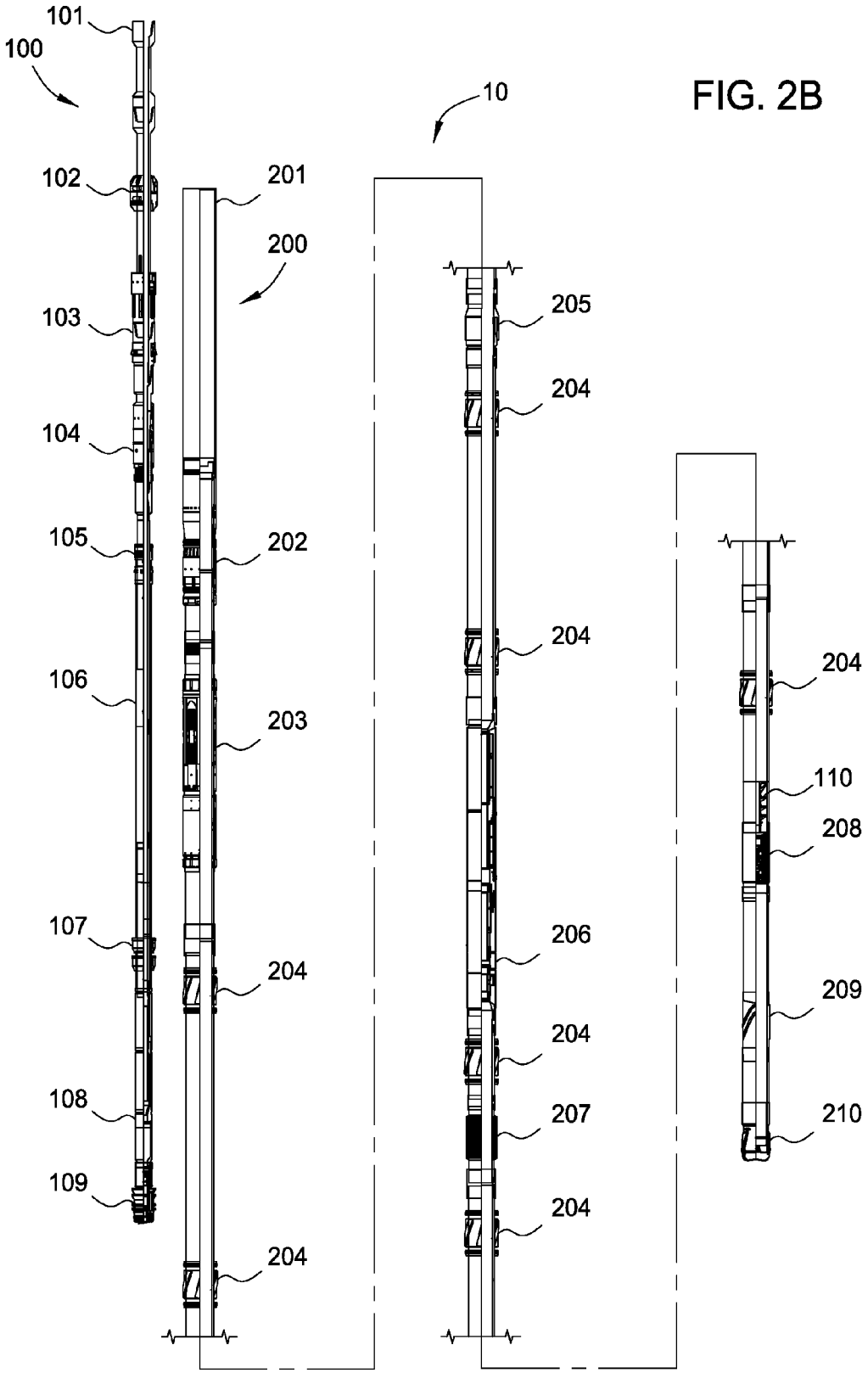

As illustrated in FIG. 2B, when the low pressure zone 6 is reached and/or when the liner assembly 10 becomes stuck within the wellbore 2, a ball, dart, or other similar type of blocking member can be pumped or dropped into the liner assembly 10 to close fluid flow out through the end of the liner assembly 10 (which in some situations prevents further loss of drilling fluid into the low pressure zone 6). The liner assembly 10 can then be pressurized to actuate the liner hanger 7, the swivel 9, and the annular packer 13. The liner hanger 7, the swivel 9, and the annular packer 13 can be actuated simultaneously and/or can be staged such that the liner hanger 7 is actuated into engagement with the wellbore 2 prior to actuation of the swivel 9, and the swivel 9 is actuated prior to actuation of the annular packer 13 into engagement with the wellbore 2. According to alternative embodiments, the liner hanger 7, the swivel 9, and/or the annular packer 13 can be actuated simultaneously or in staged manner using one or more of hydraulic, pneumatic, electric, and mechanical forces. The liner hanger 7, the swivel 9, and/or the annular packer 13 can be actuated prior to actuating the liner packer 5 and/or the port collar 11.

The liner hanger 7 may comprise slips, or other gripping-type members, configured to engage the wellbore 2 to secure the liner assembly 10 axially within the wellbore 2. The liner hanger 7 may comprise a bearing assembly that allows rotation of the liner assembly 10 after the slips have been actuated into engagement with the wellbore 2. Fluid flow may bypass the slips after engagement with the wellbore. The slips of the liner hanger 7 may be actuated into engagement with the wellbore 2 using one or more of hydraulic, pneumatic, electric, and mechanical forces.

The swivel 9 may be configured to rotationally decouple the portion of the liner assembly 10 above the swivel 9 from the portion of the liner assembly 10 below the swivel 9. In the event that lower end of the liner assembly 10 and/or the drill bit 15 becomes stuck in the wellbore 2 and prevented from rotation, at least the portion of the liner assembly 10 above the swivel 9 can be rotated when the swivel 9 is actuated into a rotationally decoupled position. The swivel 9 can be any of the swivels 100, 200, 300, 400, 500, 600, and 700 as described in U.S. Provisional Patent Application Ser. No. 61/994,629, filed May 17, 2014, the contents of which are incorporated herein by reference in their entirety. The swivel 9 may be actuated into a rotationally decoupled position using one or more of hydraulic, pneumatic, electric, and mechanical forces.

The annular packer 13 may comprise a sealing element configured to sealingly engage the wellbore 2 to fluidly isolate the section of the wellbore 2 above the annular packer 13 from the low pressure zone 6 (which in some situations prevents further loss of drilling fluid from the annulus 4 into the low pressure zone 6). The annular packer 13 may be configured to form a seal against an open hole (or unlined) section of the wellbore 2. Fluid in the annulus 4 is prevented from flowing across the annular packer 13 when actuated into engagement with the wellbore 2. The sealing element of the annular packer 13 may be actuated into engagement with the wellbore 2 using one or more of hydraulic, pneumatic, electric, and mechanical forces.

As illustrated in FIG. 1C, the port collar 11 is actuated to open a port of the port collar 11 that provides fluid communication between the inner bore of the liner assembly 10 and the annulus 4 of the wellbore 2. The port collar 11 can be actuated between an open position that opens fluid communication between the inner bore of the liner assembly 10 and the annulus 4 of the wellbore 2, and a closed position that closes fluid communication between the inner bore of the liner assembly 10 and the annulus 4 of the wellbore 2. The port collar 11 may be actuated into the open position after the annular packer 13 has been actuated into engagement with the wellbore 2. The port collar 11 may be actuated into the open position and/or the closed position using one or more of hydraulic, pneumatic, electric, and mechanical forces. The port collar 11 may include any port collars, stages tools, stage collars, and other similar devices as known in the art that is configured to be selectively and/or remotely opened and closed to open and close fluid communication between the interior of the liner assembly 10 and the annulus 4 of the wellbore 2 surrounding the liner assembly 10.

In one embodiment, the port collar 11 can be actuated into the open position using a coded pressure pulse, and actuated into the closed position using a Radio-Frequency Identification (RFID) tag. A coded pressure pulse may include one or more hydraulic pressure pulses communicated to the port collar 11 in a unique pattern and/or in a specific timed manner. The RFID tag may include a passive tag or an active tag that communicates a signal to a RFID tag reader (as known in the art) that is coupled to the port collar 11.

According to one example, a coded pressure pulse may be communicated from the surface to the port collar 11, and after receiving the coded pressure pulse, a timer on the port collar 11 may initiate actuation of the port collar 11 into the open position after a pre-determined amount of time has passed. Subsequently, an RFID tag may be dropped from the surface and communicate a signal to an RFID tag reader of the port collar 11, and after communication of the signal, the timer on the port collar 11 may initiate actuation of the port collar 11 into the closed position after a pre-determined amount of time has passed.

In one embodiment, the port collar 11 can be actuated into the open and/or closed positions using hydraulic pressure or a coded pressure pulse. In one embodiment, the port collar 11 can be actuated into the open position using hydraulic pressure or a coded pressure pulse, and actuated into the closed position using a mechanical force. In one embodiment, the port collar 11 can be actuated into the open position using hydraulic pressure or a coded pressure pulse, and actuated into the closed position using an RFID tag.

In one embodiment, the port collar 11 can be actuated into the open position using hydraulic pressure or a coded pressure pulse, and automatically actuated into the closed after a pre-determined amount of time has passed. In one embodiment, the port collar 11 can be actuated into the open and/or closed positions using any one or combination of hydraulic pressure, a coded pressure pulse, a mechanical force, an electric force, a pneumatic force, an RFID tag, and a timer configured to initiate actuation after a pre-determined amount of time has passed.

Referring to FIG. 1C, cement (identified by reference arrow 12) is circulated down through the inner bore of the liner assembly 10, out into the annulus 4 of the wellbore 2 through the port of the port collar 11 at a location above the annular packer 13, and back up to the surface through the annulus 4. The annular packer 13 prevents the cement from flowing down into the low pressure zone 6. While the cement is circulated to the surface through the annulus 4, the swivel 9 enables the portion of the liner assembly 10 above the swivel 9 to be rotated relative to the portion of the liner assembly 10 below the liner assembly 10 to provide a uniform distribution of the cement within the annulus 4 and around the liner assembly 10. As noted above, the cement flow can bypass the slips of the liner hanger 7, and the liner hanger 7 is configured to rotate after the slips have been actuated into engagement with the wellbore 2.

As illustrated in FIG. 1D, after the cementing operation is complete, the port collar 11 can be actuated into the closed position, and the liner packer 5 is actuated into engagement with the wellbore 2. The liner packer 5 may comprise a sealing element similar to the annular packer 14. As noted above, the port collar 11 can be actuated into the closed position any number of ways, including dropping an RFID tag into the liner assembly 10 to communicate a signal to actuate the port collar 11 and/or using a timer configured to initiate actuation of the port collar 11 after a pre-determined amount of time has passed. Once the liner assembly 10 is cemented in the wellbore, another liner assembly, drill string, or other similar work string can be lowered and drilled through the interior of the liner assembly 10. The liner assembly 10 may be used to drill the wellbore 2 and then be cemented within the wellbore 2 in a single trip, without removing the liner assembly 10 from the wellbore 2.

FIG. 2A illustrates a drilling liner assembly 10, according to one embodiment. The liner assembly 10 comprises a running string 100 and a liner string 200. The running string 100 is configured to lower and rotate the liner string 200 to drill a wellbore, such as wellbore 2 illustrated in FIG. 1A. In one embodiment, the liner assembly 10 can be inserted and lowered into a previously drilled wellbore. The liner string 200 can be suspended from the wall of the wellbore 2 and/or from a casing or liner string previously installed within the wellbore 2.

The running string 100 includes a top sub 101, a junk bonnet 102, a packer actuator 103, a setting tool 104, a seal mandrel 105, a polished stinger 106, a swab cup 107, a ball seat 108, a closing plug 109, and a shut off plug 110. The components of the running string 100 when coupled together form an inner bore that is disposed through the longitudinal length of the running string 100. The components of the running string 100 may be coupled directly or indirectly to each other in at least the order illustrated in FIG. 2A.

The liner string 200 includes a polished bore receptacle 201, a liner packer 202, a liner hanger 203, centralizers 204, a swivel 205, a port collar 206, an annular packer 207, a float collar 208, a stabilizer 209, and a drill bit 210. The liner packer 202, the liner hanger 203, the swivel 205, the port collar 206, and the annular packer 207 may be the same as the liner packer 5, the liner hanger 7, the swivel 9, the port collar 11, and the annular packer 13 described above with respect to FIG. 1A-1C. The components of the liner string 200 when coupled together form an inner bore that is disposed through the longitudinal length of the liner string 200. The components of the liner string 200 may be coupled directly or indirectly to each other in at least the order illustrated in FIG. 2A.

Although the running string 100 is illustrated in FIG. 2A-2F as being positioned next to the liner string 200, it is understood that when the liner assembly 10 is assembled, the running string 100 is inserted into the liner string 200 such that the junk bonnet 102 is located at the upper end of the polished bore receptacle 201. Specifically, the portion of the running string 100 above the junk bonnet 102 is disposed above the liner string 200, and the portion of the running string 100 below the junk bonnet 102 is positioned within the liner string 200 when the liner assembly 10 is lowered into a wellbore. The junk bonnet 102 prevents debris within the wellbore from flowing into the liner string 200. The running string 100 may be disconnected from the liner string 200 when located within the wellbore and retrieved separately back to the surface as further described below.

Referring to FIG. 2A, the liner string 200 may be coupled to and suspended from the running string 100. In one embodiment, the liner string 200 may be coupled to the running string 100 by a releasable connection formed between the setting tool 104 and the liner packer 202. For example, the setting tool 104 may include a hydraulically released mechanical lock as known in the art, which is configured to transmit torque to the liner string 200 via the liner packer 202, and when desired is releasable from the liner string 200 using a combination of a hydraulic force and rotation to remove the mechanical lock between the setting tool 104 and the liner packer 202.

The top sub 101 may be coupled to a work string that extends to the surface and is configured to lower the running string 100 and the liner string 200 into a wellbore. The running string 100 and the liner string 200 may be rotated via the work string to rotate the drill bit 210 located at the lower end of the liner string 200 to drill a wellbore. In one embodiment, the liner string 200 may include a motor (such as a drilling motor powered by drilling fluid as known in the art) configured to rotate the drill bit 210 relative to the remainder of the liner string 200 and the running string 100 so that the entire liner assembly 10 does not have to be rotated to drill the wellbore. The motor and drill bit 210 may be drilled through when the liner string 200 is cemented in place as further described below.

Drilling fluid (identified by reference arrow 8) may be pumped through the inner bores of the running string 100 and the liner string 200 and out the lower end of the liner string 200, and circulated back up to the surface through the annulus formed between the outer surface of the liner assembly 10 and the surrounding wellbore. In some situations, the drilling fluid may flow into a low pressure zone such that circulation of the drilled earth and other wellbore debris back to the surface is stopped, which can prevent further rotation of the liner assembly 10 and/or the drill bit 210 and cause the liner assembly 10 to become stuck within the wellbore. Alternatively, the liner assembly 10 may be lowered into a previously drilled wellbore. One or more of the centralizers 204 and/or the stabilizer 209 may be used to center and stabilize the liner string 200 within the wellbore.

Referring to FIG. 2B, a ball, dart, or other similar type of blocking member can be pumped or dropped into the running string 100 and specifically onto a seat of the shut off plug 110 to close fluid flow through the shut off plug 110. The pressure above may then be increased to release the shut off plug 110 from the running string 100, and pump the shut off plug 110 onto a seat of the float collar 208 to close fluid flow through the float collar 208, which closes fluid flow out through the lower end of the liner string 200. The liner string 200 can then be pressurized internally.

Figure 2C:
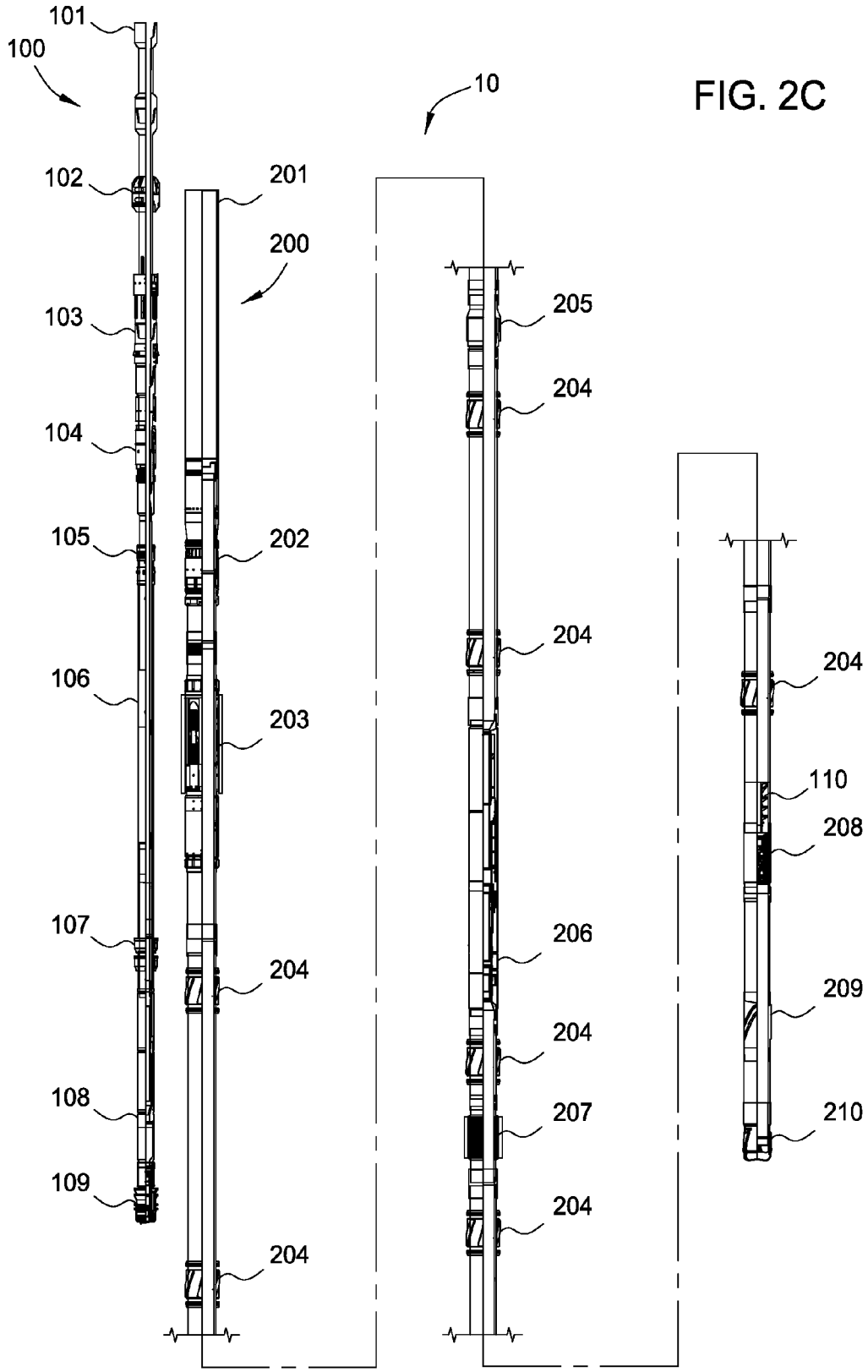

Referring to FIG. 2C, the pressure within the liner string 200 can be increased to actuate the setting tool 104, the liner hanger 204, the swivel 205, and the annular packer 207. The setting tool 104 may be actuated to at least partially release the running tool from the liner string 200. Slips of the liner hanger 204 may be actuated into engagement with the wellbore to secure the liner string within the wellbore. The swivel 205 may be actuated to rotationally decouple the portion of the liner string 200 above the swivel 205 from the portion of the liner string 200 below the swivel 205. A packing element of the annular packer 207 may be actuated into engagement with the wellbore to form a seal and isolate the annulus of the wellbore above the annular packer 207.

In one embodiment, the setting tool 104 and the liner hanger 204 may be actuated at the same pressure (e.g. 2,500-3,000 psi) and before the actuation of the swivel 205 and/or the annular packer 207. The setting tool 104 and/or the liner hanger 204 may be actuated at a pressure less than the pressure at which the swivel 205 is actuated (e.g. 3,500 psi). The swivel 205 may be actuated before and at a pressure less than the pressure at which the annular packer 207 is actuated (e.g. 4,500 psi).

Figure 2D:
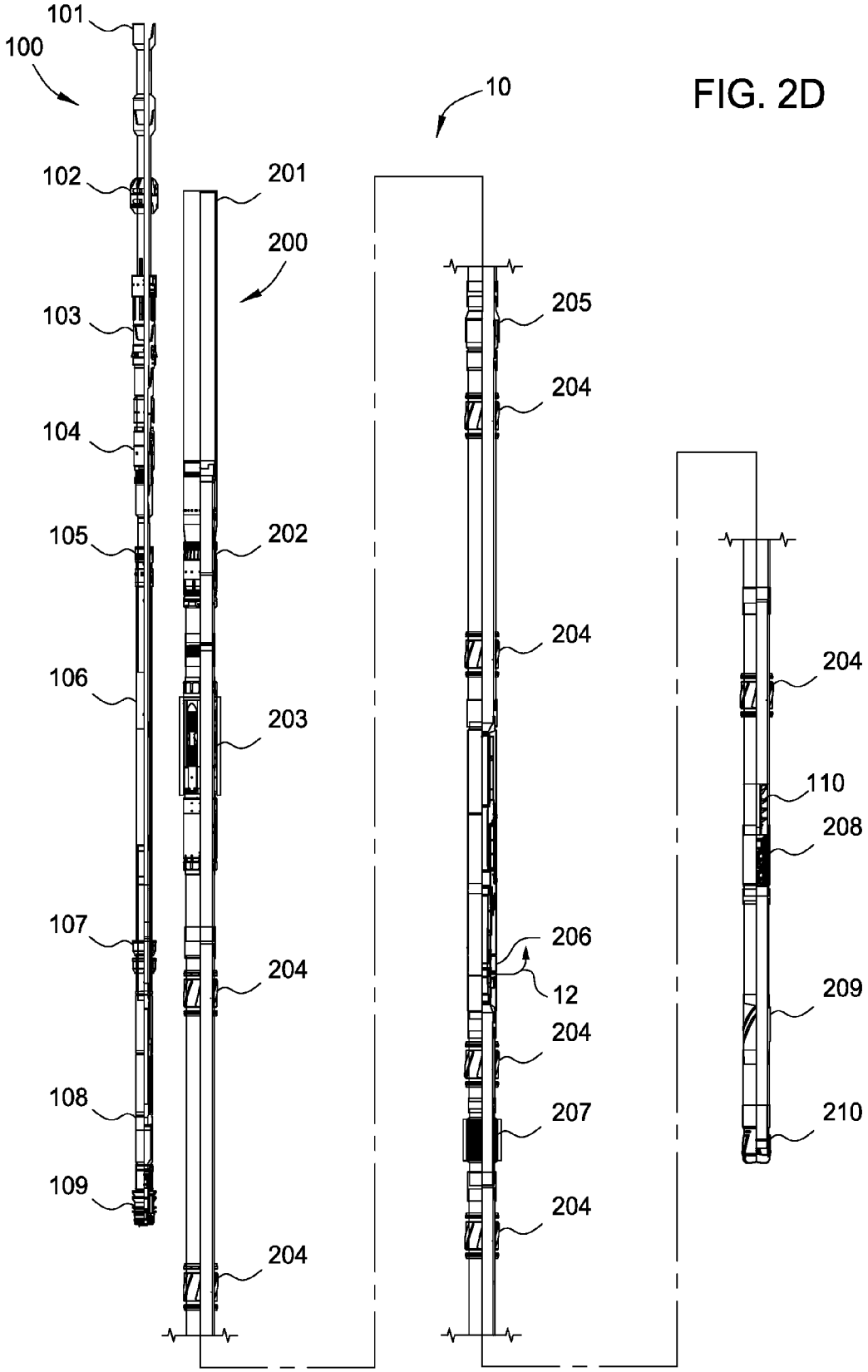

Referring to FIG. 2D, the weight of the running string 100 and/or the work string supporting the running string 100 may be set down to ensure that the slips of the liner hanger 203 are engaged with the surrounding wellbore walls. The running string 100 may be rotated to fully release the running string 100 from the liner string 200. For example, the setting tool 104 may be rotated relative to the liner packer 202 to release a mechanical lock between the setting tool 104 and the liner packer 202. Subsequently, the running string 100 can be lifted out of the liner string 200 when ready to be retrieved to the surface.

Optionally, in the event that the running string 100 is not disconnected from the liner string 100, another ball, dart, or other similar type of blocking member can be pumped or dropped into the running string 100 and specifically into the ball seat 108 to close fluid flow through the ball seat 108 to assist in releasing the running string 100 from the liner string 200. For example, the running string 100 can then be pressurized to actuate a secondary hydraulic release mechanism (e.g. a shifting sleeve as known in the art) of the setting tool 104 to disengage from the liner packer 202. Subsequently, the ball seat 108 can be expanded via hydraulic and/or mechanical force to re-open fluid communication into the liner string 100. Examples of a ball seat 108 that can be used with the embodiments disclosed herein are the ball seats described in U.S. Pat. No. 6,866,100, the contents of which are herein incorporated by reference in their entirety.

As further shown in FIG. 2D, a coded pressure pulse may be communicated from the surface through the inner bores of the work string, the running tool 100, and the liner string 200 to the port collar 206, to actuate the port collar 206 into an open position. The port collar 206 may be actuated into the open position after the annular packer 207 has been actuated into engagement with the wellbore. The port collar 206 may be configured to move into the open position a pre-determined amount of time after receiving the coded pressure pulse.

The port collar 206 may be actuated to open a port that opens fluid communication between the inner bore of the liner string 200 and the annulus surrounding the liner string 200. When opened, a pre-determined amount of cement (illustrated by reference arrow 12) may be pumped down into the liner assembly 10 and out of the port of the port collar 206 into the annulus surrounding the liner string 200 at a location above the annular packer 207. Although the slips of the liner hanger 203 are engaged with the surrounding wellbore, cement may by-pass the slips, and the portion of the liner string 200 above the swivel 205 may be rotated to help distribute the cement within the annulus surrounding the liner string 200. Although the swivel 205 is positioned above the port collar 206, in an alternative embodiment, the swivel 205 can be positioned below the port collar 206 such that the port collar 206 can be rotated while the cement is pumped into the annulus.

Figure 2E:
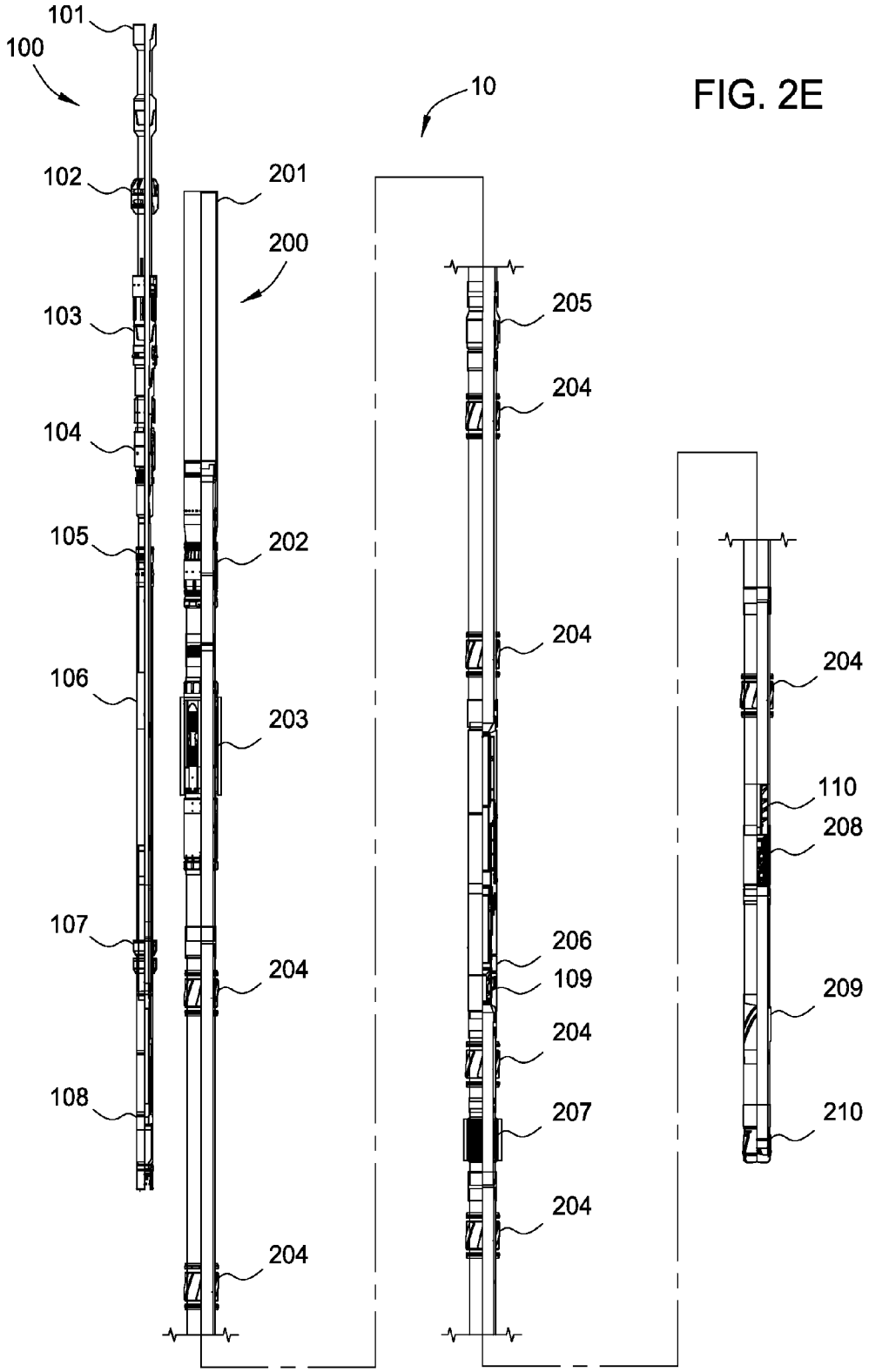

Referring to FIG. 2E, a cement plug following the predetermined amount of cement pumped into the liner assembly 10 may land on a seat of the closing plug 109 and close fluid flow through the closing plug 109. The pressure above may be increased to release the closing plug 109 from the running string 100 and pump the closing plug onto a seat of the port collar 206 to close fluid flow through the port collar 206. For example, the pressure above the closing plug 109 can be increased to actuate the port collar 206 into a closed position, such as by shifting a sleeve of the port collar 206 to close fluid flow through the port of the port collar 206. Alternatively, a mechanical shifting tool can be lowered into the port collar 206 actuate the port collar 206 into a closed position, such as by shifting a sleeve of the port collar 206 to close fluid flow through the port of the port collar 206. Alternatively, an RFID tag can be pumped or dropped into the port collar 206 to communication a signal to the port collar 206 that initiates actuation of the port collar 206 into the closed position.

Figure 2F:
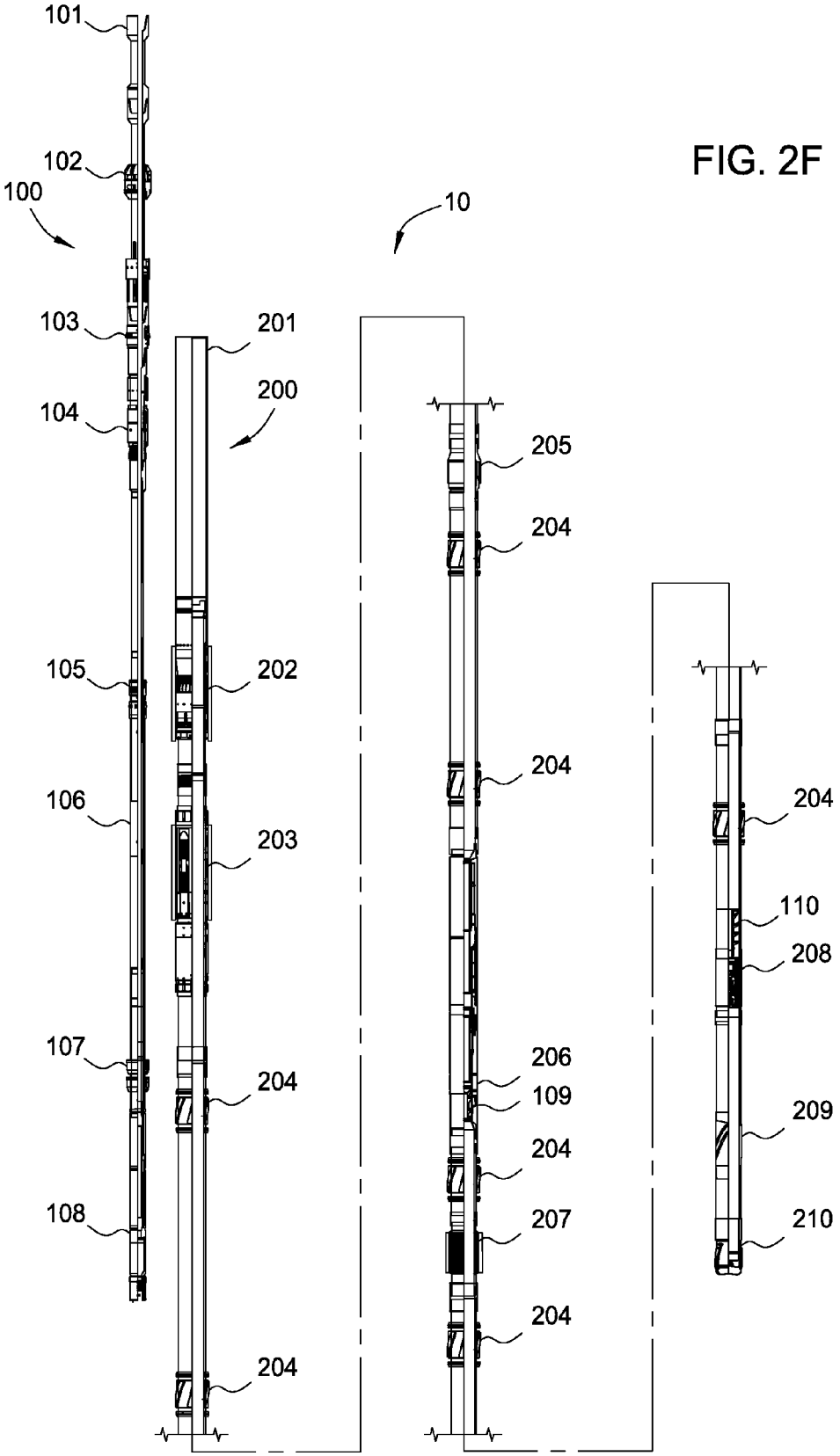

Referring to FIG. 2F, the running string 100 can be raised relative to the liner string 200 to lift the packer actuator 103 to a position above the polished bore receptacle 201. When positioned above the polished bore receptacle 201, one or more setting members, such as spring biased dogs as known in the art, of the packer actuator 103 may move radially into an expanded position such that subsequent lowering of the running string 100 lowers the setting members into engagement with the upper end of the polished bore receptacle 201. The weight of the running string 100 can be set down onto the upper end of the liner string 200 to actuate a packing element of the liner packer 202 into engagement with the surrounding wellbore to form a seal. Examples of a packer actuator 103 with spring biased dogs that can be used with the embodiments disclosed herein are described in U.S. Pat. No. 5,813,458, the contents of which are herein incorporated by reference in their entirety.

After the liner packer 202 has been actuated, the running string 100 may be lifted back to the surface. A reverse circulation operation may be conducted to remove any excess cement above the liner packer 202. A drill string or another liner assembly 10 can be lowered into the wellbore and drilled through the interior of the cemented liner string 200.

FIG. 3A-3G illustrates a drilling liner assembly 10, according to one embodiment. The drilling liner assembly 10 may be operated in the same manner as the drilling liner assembly 10 illustrated and described above with respect to FIG. 2A-2F. The same components of the running string 100 and the liner string 200 include the same reference numbers, and the operation of each component will not be repeated herein for brevity. The primary difference regarding the liner assembly 10 illustrated in FIG. 3A-3G is that that liner string 200 includes two port collars, a first or upper port collar 206A positioned above a second or lower port collar 206B (with the swivel 205 and optional centralizers 204 positioned between).

Figure 3A:
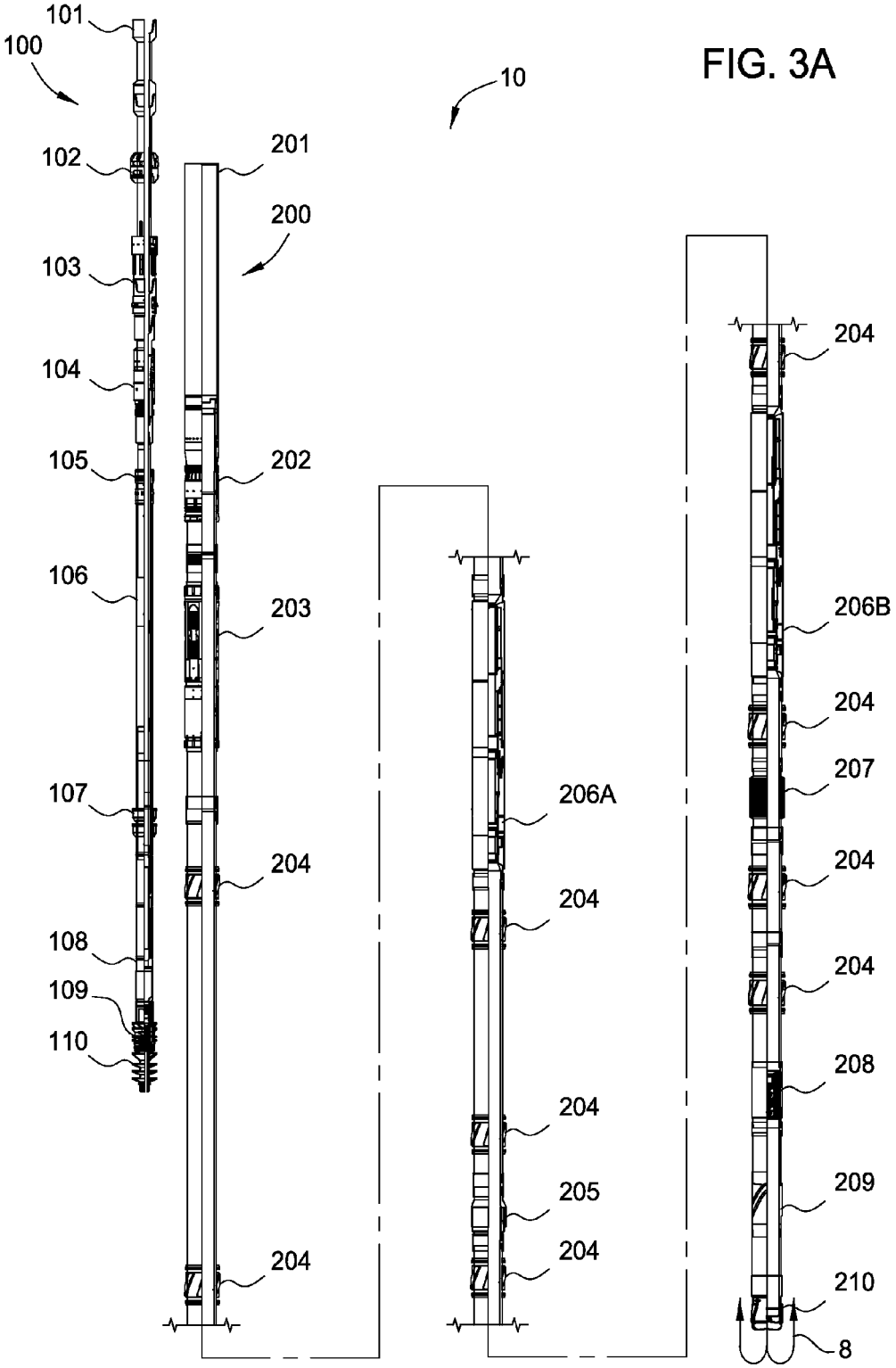
FIGS. 3A, 3B, 3C, 3D, 3E, 3F, and 3G illustrate a drilling liner assembly according to one embodiment.

According to one embodiment, the liner assembly 10 illustrated in FIG. 3A may be operated in the same manner as described with respect to the liner assembly 10 illustrated in FIG. 2A-2F. Specifically, the upper port collar 206A is the primary port collar through which cement is pumped, and the lower port collar 206B is a back-up port collar in the event that the upper port collar 206A cannot be actuated into the open position by the coded pressure pulse. In the event that the upper port collar 206A fails to open, another coded pressure pulse can be communicated to the lower port collar 206B to actuate the lower port collar 206B into the open position (after a pre-determined amount of time has passed) so that cement can be pumped into the annulus surrounding the liner string 200. An RFID tag can be dropped into the lower port collar 206B subsequent to the cementing operation to communicate a signal to the lower port collar 206B that initiates actuation of the lower port collar 206B into the closed position. Alternatively, a mechanical shifting tool can be lowered into the lower port collar 206B to actuate the lower port collar 206B into the closed position, such as by shifting a sleeve of the lower port collar 206B to close fluid flow through the port of the lower port collar 206B.

According to one embodiment, both the upper port collar 206A and the lower port collar 206B may be used to cement the liner string 200 in the wellbore as further described below.

Figure 3B:
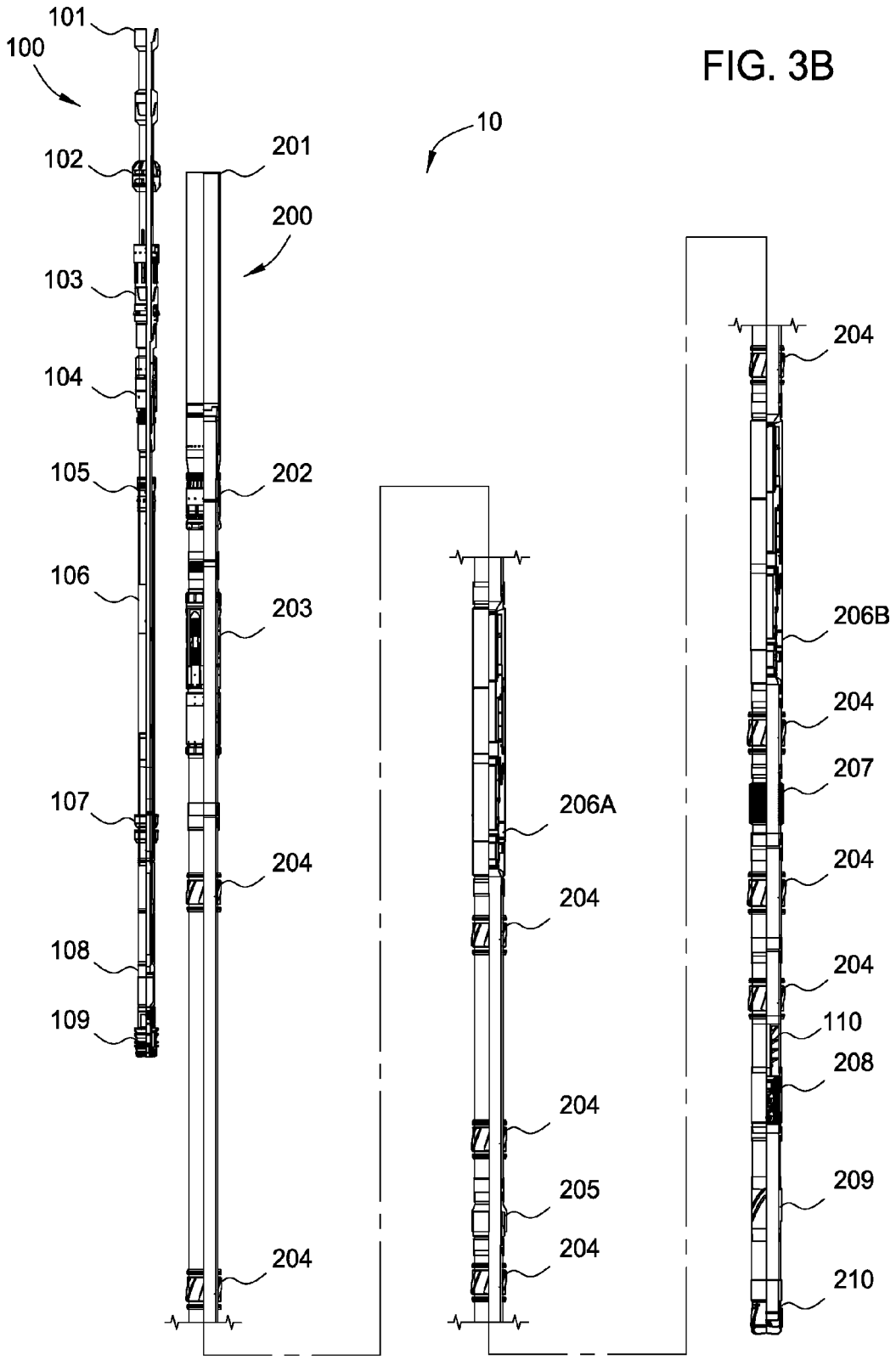

Referring to FIG. 3A-3B, the top sub 101 may be coupled to a work string that extends to the surface, which is used to lower and rotate the running string 100 and the liner string 200. Rotation of the liner string 200 rotates the drill bit 210 located at the lower end of the liner string 200 to drill a wellbore. Drilling fluid (identified by reference arrow 8) may be pumped through the inner bores of the running string 100 and the liner string 200, and then circulated back up to the surface through the annulus formed between the outer surface of the liner assembly 10 and the surrounding wellbore. A ball, dart, or other similar type of blocking member can be pumped or dropped onto the seat of the shut off plug 110 to release the shut off plug 110 from the running string 100. The shut off plug 110 may land onto a seat of the float collar 208, which closes fluid flow out through the lower end of the liner string 200. The liner string 200 can then be pressurized internally.

Figure 3C:
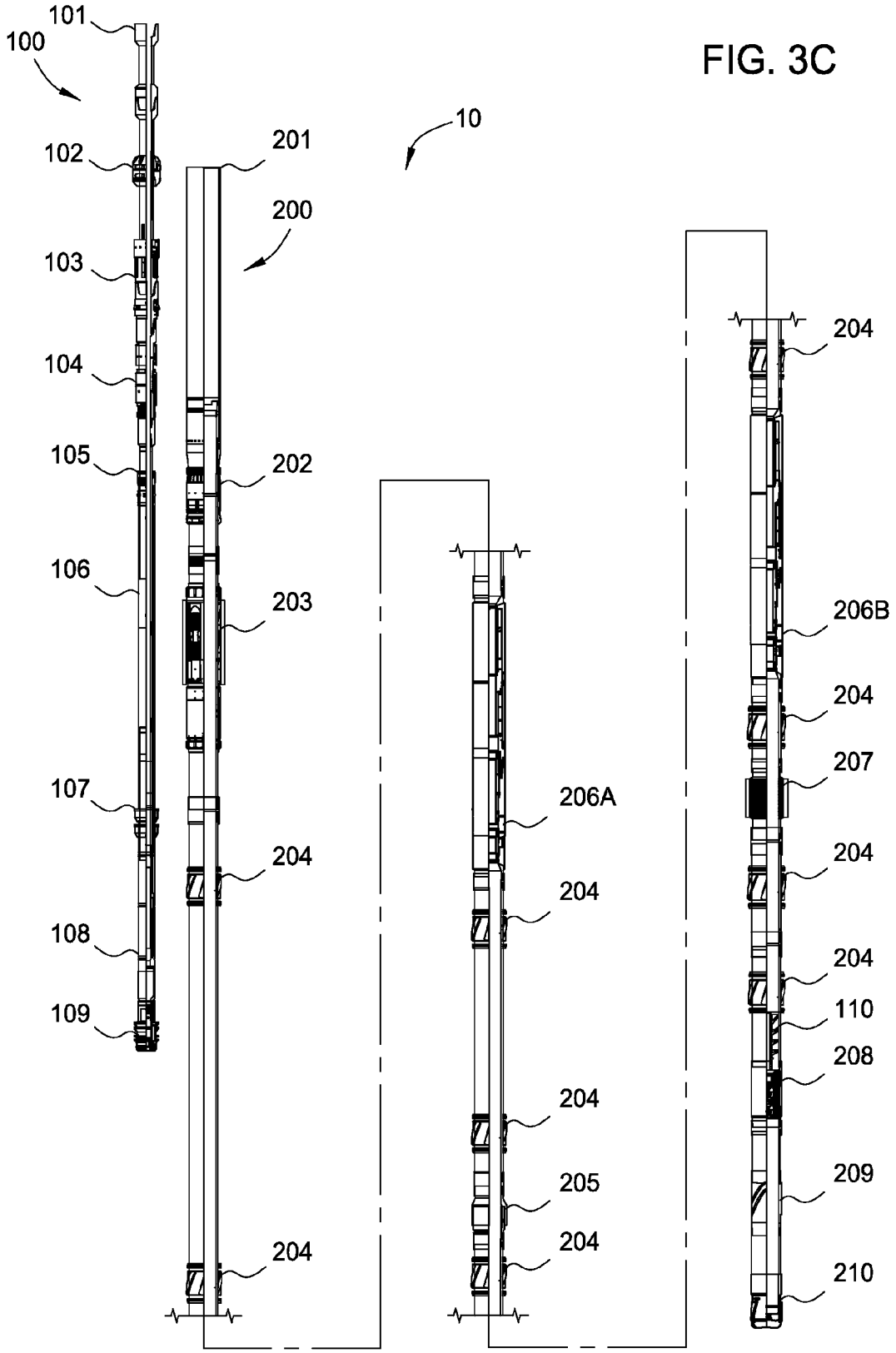

Referring to FIG. 3C, the pressure within the liner string 200 can be increased to actuate the setting tool 104, the liner hanger 204, the swivel 205, and the annular packer 207 as described above with respect to FIG. 2A-2F.

Figure 3D:
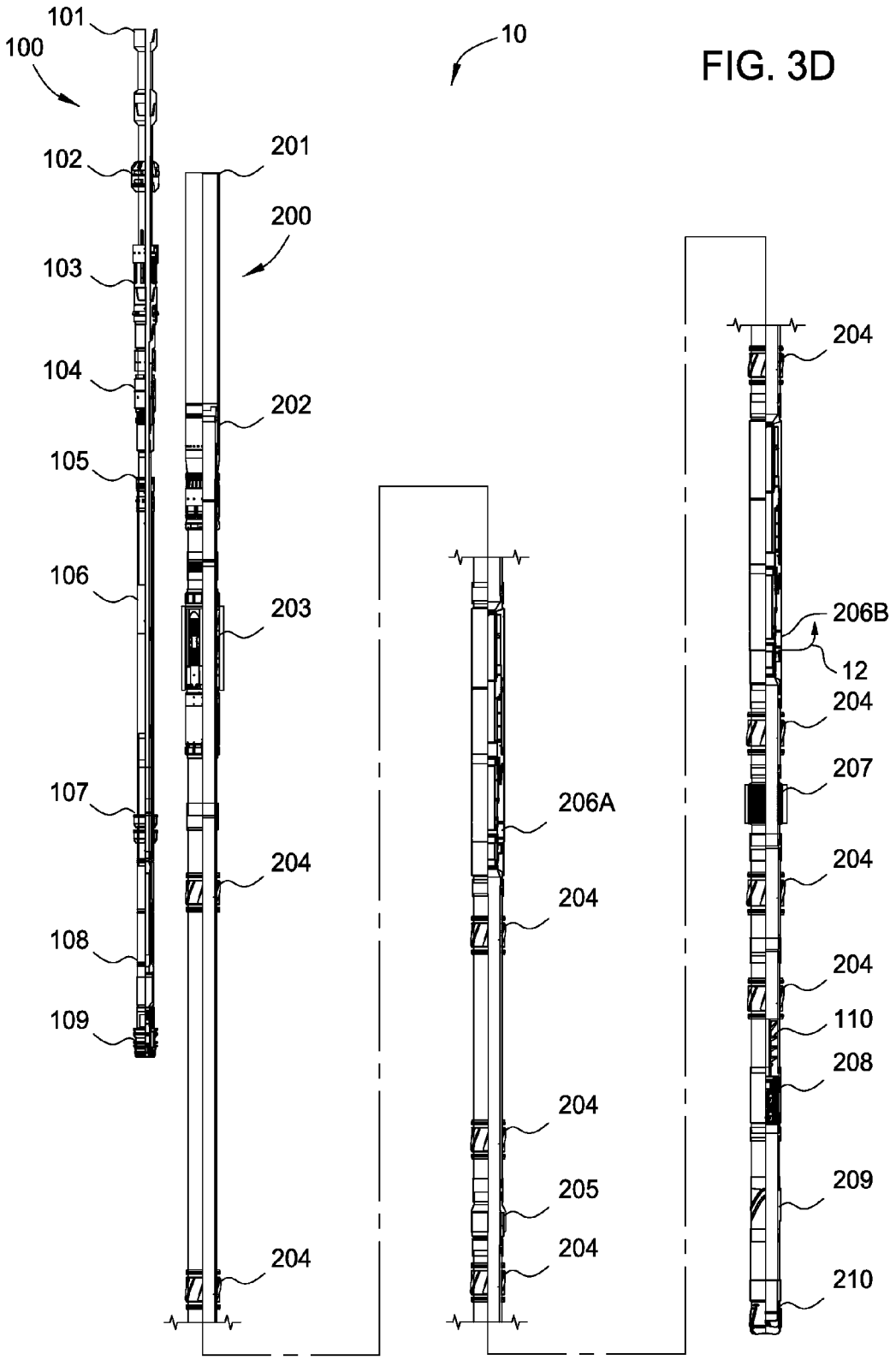

Referring to FIG. 3D, a coded pressure pulse may be communicated from the surface through the inner bores of the work string, the running tool 100, and the liner string 200 to the lower port collar 206B, to actuate the lower port collar 206B into the open position. The lower port collar 206B may be configured to move into the open position a pre-determined amount of time after receiving the coded pressure pulse. A pre-determined amount of cement (illustrated by reference arrow 12) may be pumped down into the liner assembly 10 and out of the port of the lower port collar 206B into the annulus surrounding the liner string 200. The pre-determined amount of cement may be sufficient to fill the annulus surrounding the liner string 200 from the annular packer 207 up to the upper port collar 206A. An RFID tag may subsequently be pumped or dropped into the lower port collar 206B to communication a signal to the lower port collar 206B that initiates actuation of the port collar 206B into the closed position. The lower port collar 206B may be configured to move into the closed position a pre-determined amount of time after receiving the signal from the RFID tag.

Figure 3E:
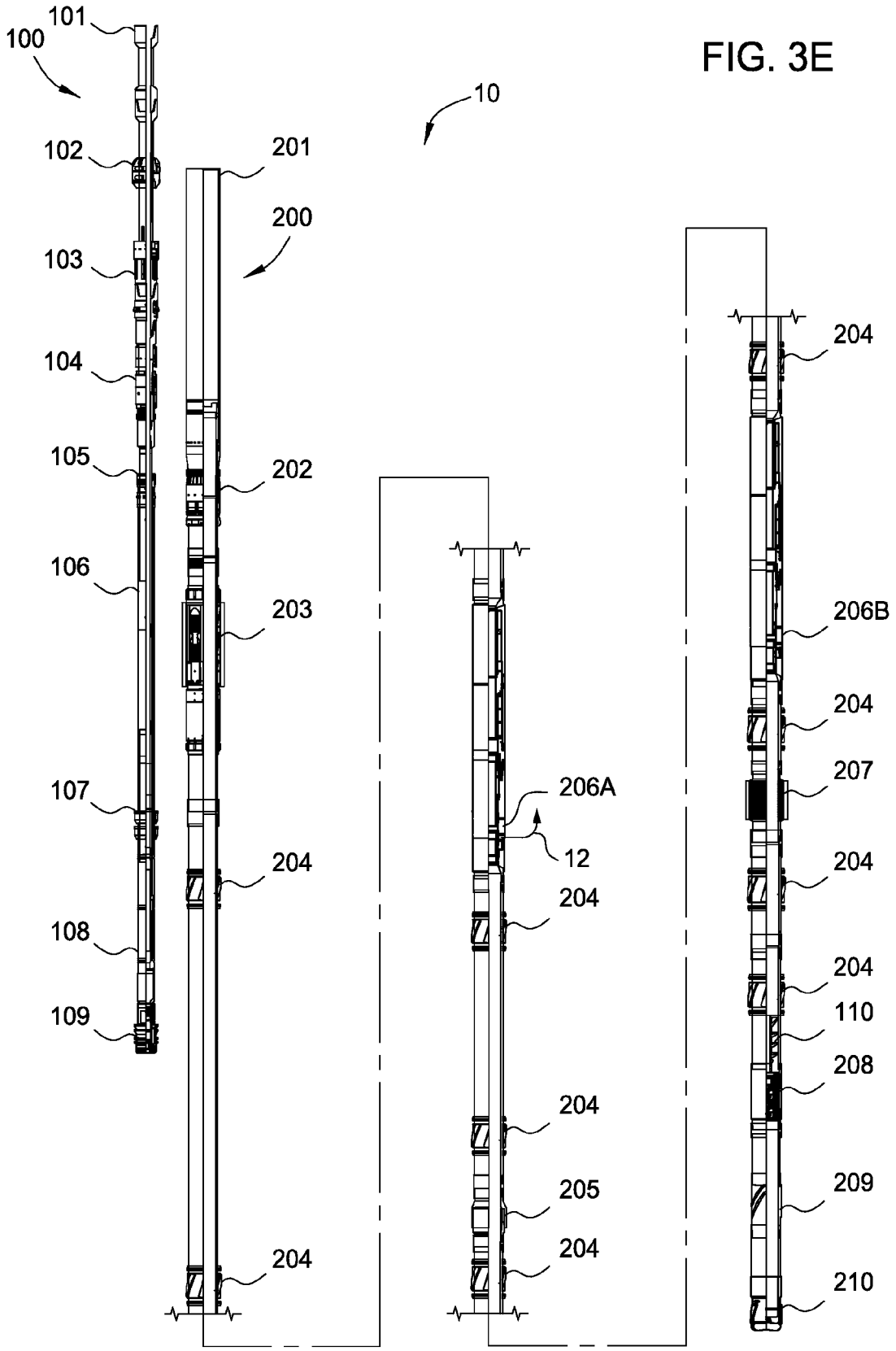

Referring to FIG. 3E, another coded pressure pulse may be communicated from the surface through the inner bores of the work string, the running tool 100, and the liner string 200 to the upper port collar 206A, to actuate the upper port collar 206A into the open position. The upper port collar 206A may be configured to move into the open position a pre-determined amount of time after receiving the coded pressure pulse. A pre-determined amount of cement (illustrated by reference arrow 12) may be pumped down into the liner assembly 10 and out of the port of the upper port collar 206A into the annulus surrounding the liner string 200. The pre-determined amount of cement may be sufficient to fill the annulus surrounding the liner string 200 from the upper port collar 206A up to the polished bore receptacle 201.

Figure 3F:
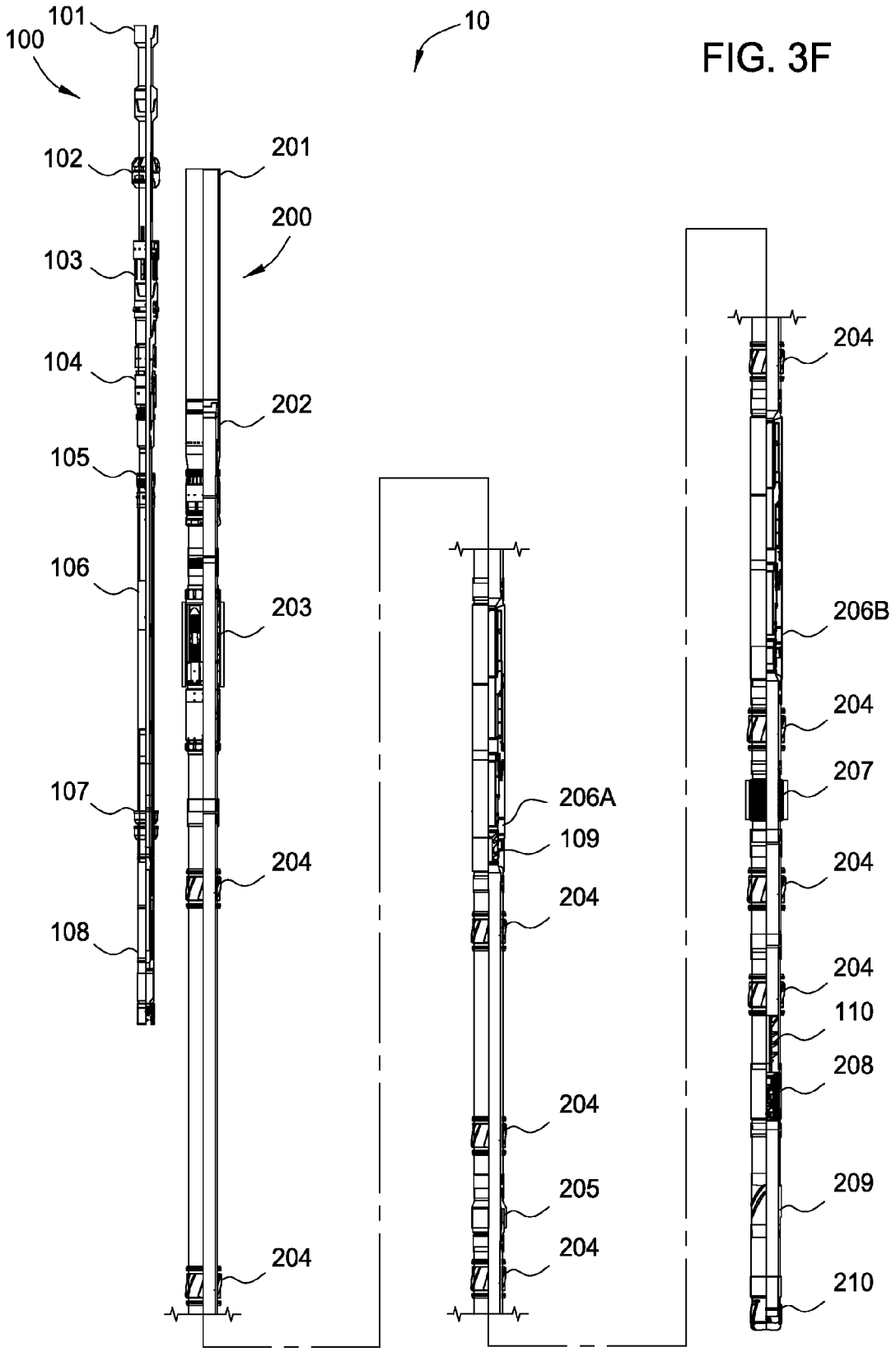

Referring to FIG. 3F, a cement plug following the pre-determined amount of cement pumped into the liner assembly 10 may land on the seat of the closing plug 109, which is released from the running string 100 and lands on the seat of the upper port collar 206A to close fluid flow through the upper port collar 206A. For example, the pressure above the closing plug 109 can be increased to actuate the upper port collar 206A into the closed position, such as by shifting a sleeve of the upper port collar 206A to close fluid flow through the port of the upper port collar 206A. Alternatively, a mechanical shifting tool or an RFID tag can be used to actuate the upper port collar 206A into the closed position.

Figure 3G:
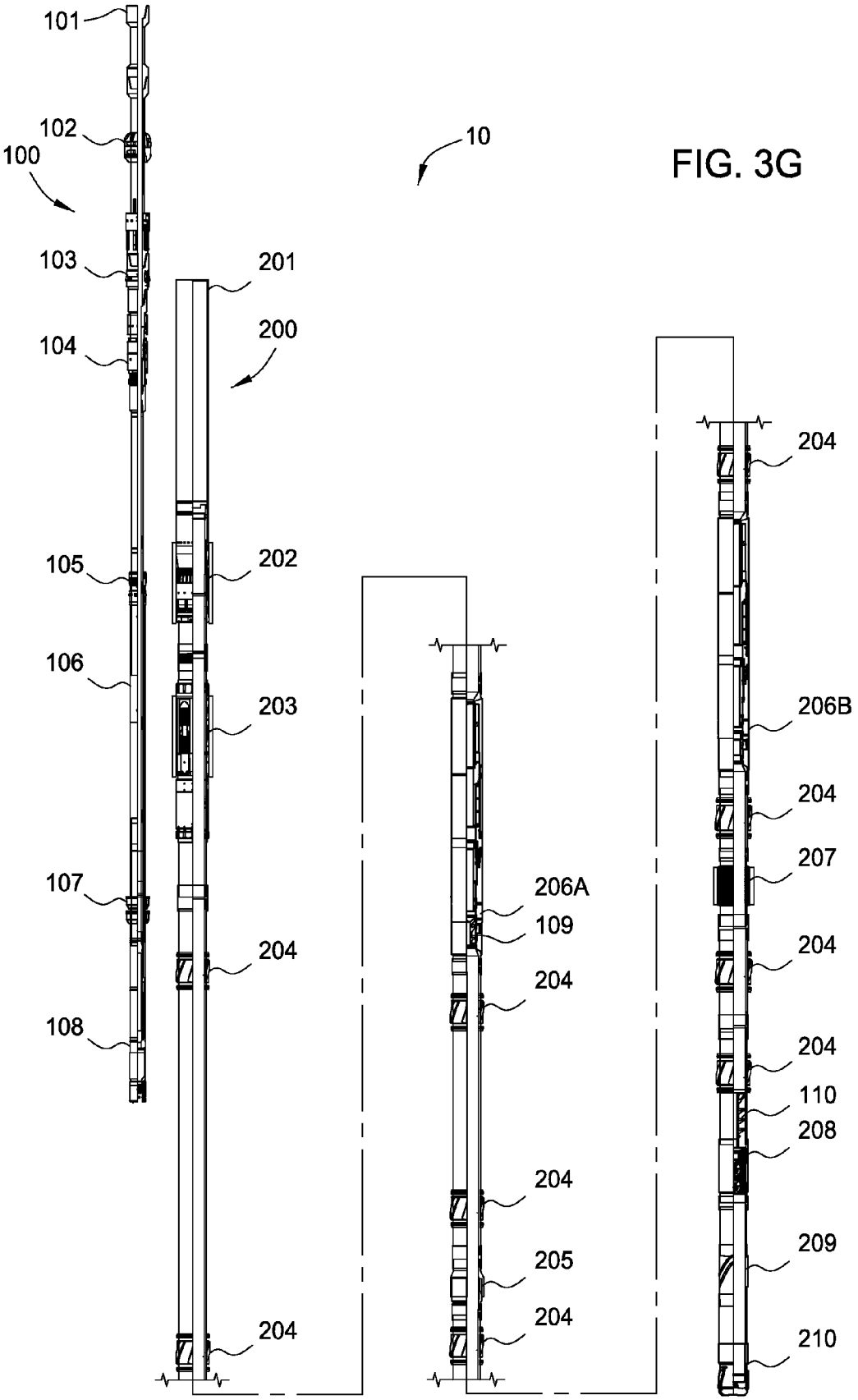

Referring to FIG. 3G, the running string 100 can be raised relative to the liner string 200 and set down weight on the liner string 200 to actuate the liner packer 202 into engagement with the surrounding wellbore. After the liner packer 202 has been actuated, the running string 100 may be lifted back to the surface. A reverse circulation operation may be conducted to remove any excess cement above the liner packer 202. A drill string or another liner assembly 10 can be lowered into the wellbore and drilled through the interior of the cemented liner string 200.

Figure 4A:
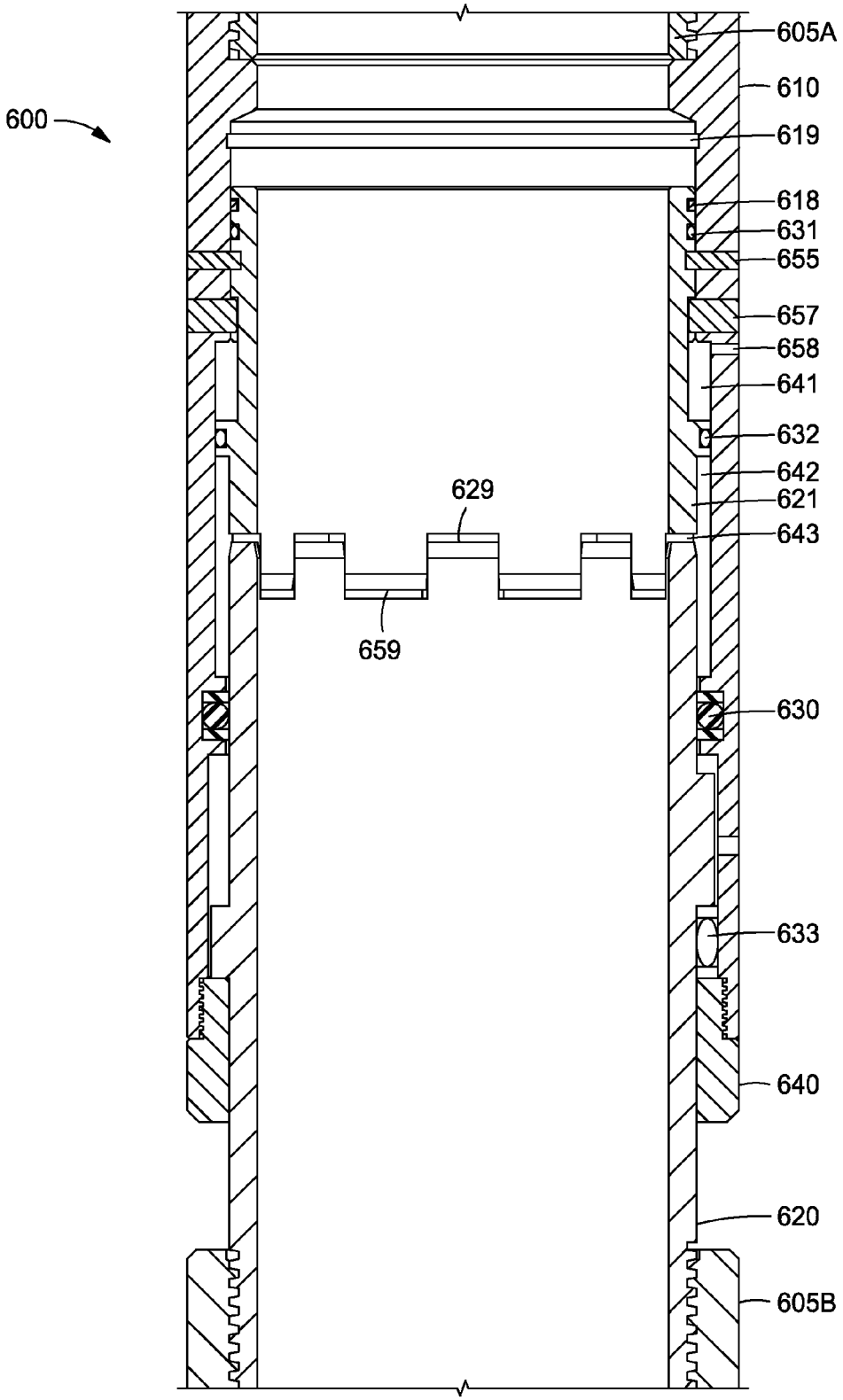
FIGS. 4A and 4B illustrate a swivel according to one embodiment.

FIG. 4A is a cross-sectional view of a swivel 600 in a first operating position. The swivel 600 may be used as the swivel 9 and the swivel 205 of the liner assembly 10 described above. In the first operating position, the swivel 600 is configured to transmit rotation of an upper section 605A of a work string to a lower section 605B of the work string. When actuated, the swivel 600 is configured to rotationally decouple the upper and lower sections 605A, 605B to allow the upper section 605A of the work string to rotate relative to the lower section 605B of the work string. The upper and/or lower sections 605A, 605B of the work string can include one or more tubular members, such as casing, liner, and/or drill pipe, which are coupled together. The upper and/or lower sections 605A, 605B of the work string can be upper and lower sections of the liner assembly 10 above and below the swivel 9 illustrated in FIG. 1A and/or the upper and lower section of the liner string 200 above and below the swivel 205 illustrated in FIG. 2A and FIG. 3A.

The swivel 600 includes an upper body 610 coupled to a lower body 620 by a ring member 621. One or more seals/bearings 630, 631, 632, 633 are disposed between the inner surface of the upper body 610 and the outer surfaces of the ring member 621 and/or the lower body 620 to form a sealed engagement and/or minimize friction between these surfaces. A load bearing member 640 is coupled to a lower end of the upper body 610 to support the weight of the lower body 620, the lower section 605B of the work string, and any other components connected below.

Rotation of the upper body 610 is transmitted to the ring member 621 by a plurality of shearable members 655 and/or a plurality of pin members 657 that are disposed through the upper body 610 and engage the ring member 621. The pin members 657 transmit rotation from the upper body 610 to the ring member 621 but extend into a longitudinal slot formed in the outer surface of the ring member 621 to allow longitudinal movement of the upper body 610 relative to the ring member 621. The rotation transmitted to the ring member 621 is transmitted to the lower body 620 by a plurality of teeth members 659 of the ring member 621 that engage a plurality of teeth members 629 of the lower body 620. The teeth members 629, 659 have corresponding square shaped, castellated profiles, although other profile shapes, such as saw tooth profiles, may be used.

When the swivel 600 is in the first operating position as shown in FIG. 4A, the upper section 605A of the work string, the swivel 600, and the lower section 605B of the work string rotate together as a single unit. The upper and lower sections 605A, 605B of the work string and any other tools coupled to the upper and lower sections 605A, 605B, including the swivel 600, can be rotated to form a wellbore and/or while being lowered into an existing wellbore. When desired, the swivel 600 can be actuated to rotationally decouple the upper section 605A of the work string from the lower section 605B of the work string as shown in FIG. 4B.

Figure 4B:
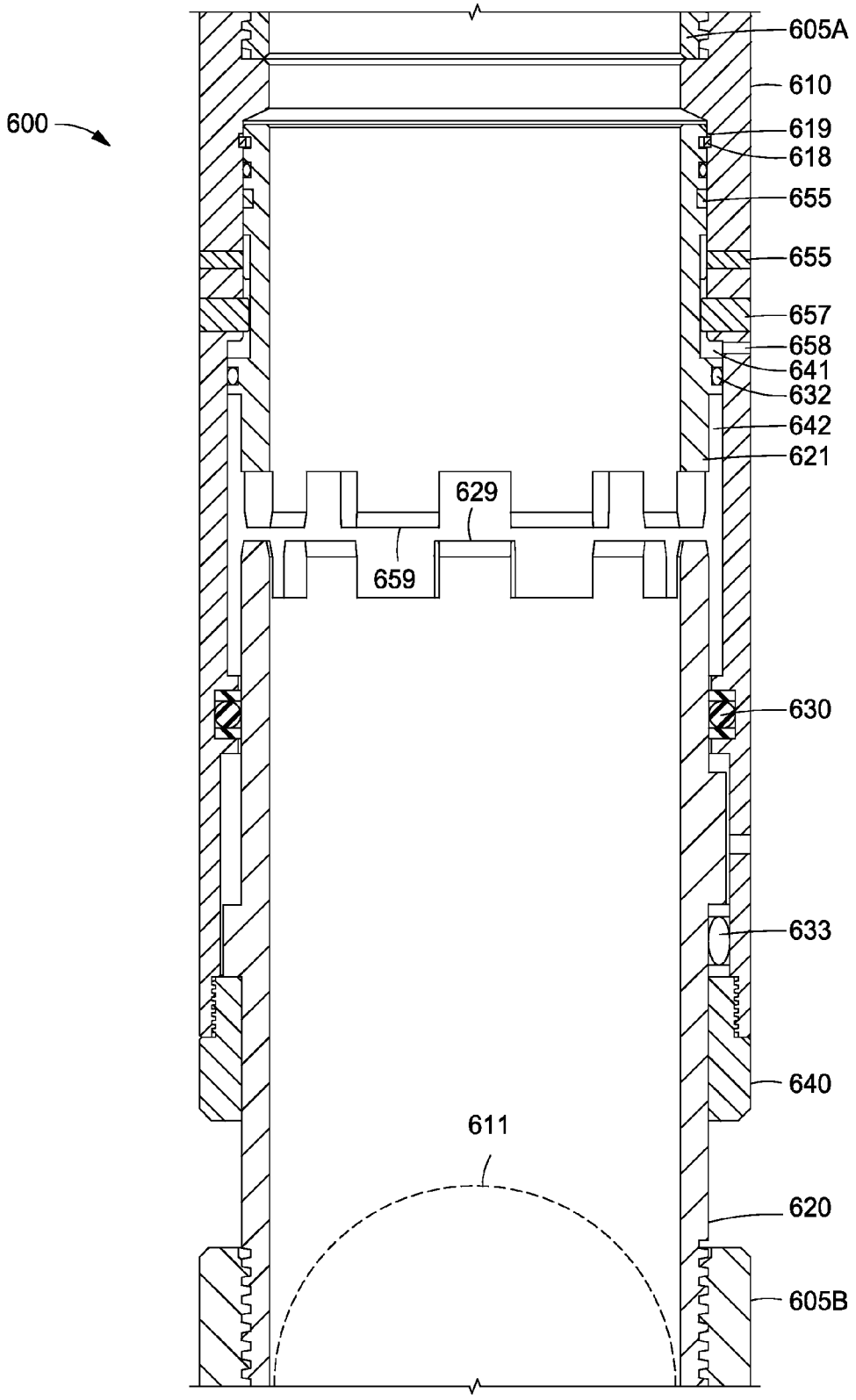

FIG. 4B is a cross-sectional view of the swivel 600 in a second operating position. To actuate the swivel 600 to the second operating position, a ball, dart, or other similar type of blocking member 611 (such as the shut off plug 110) can be dropped or pumped into the work string to a location within or below the swivel 600 to close fluid flow through the work string and allow the swivel 600 to be pressurized. Alternatively, the blocking member 611 may not be necessary if fluid flow through the work string was previously closed during a prior wellbore operation, such as an initial or primary cementing operation, performed through the work string. For example, a section of the work string below the swivel 600 may have been cemented in the wellbore during the initial or primary cementing operation in which a cement plug was dropped or pumped into the work string, which closed fluid flow through the work string, and which will allow the work string and thus the swivel 600 to be pressurized without having to drop or pump the blocking member 611 into the work string.

Pressure within the swivel 600 then can be increased to pressurize a chamber 642 via one or more openings 643 (illustrated in FIG. 4A) to a pressure greater than a pressure in a chamber 641 to apply a hydraulic, pressurized fluid upward force to the ring member 621 to shear the shearable members 655. The chambers 641, 642 are formed between the outer surface of the ring member 621 and the inner surface of the upper body 610. The chamber 641 is disposed above the chamber 642 and has a pressure equal to the surrounding annulus or wellbore pressure via one or more openings 658.

When the shearable members 655 are sheared, the pressurized fluid in the chamber 641 forces the ring member 621 to move upward relative to the upper body 610 and the lower body 620 until a snap ring 618 disposed on the outer surface of the ring member 621 engages a groove 619 formed on the inner surface of the upper body 610. The ring member 621 is also moved to a position where the teeth members 659 are disengaged from or do not contact the teeth members 629 on the lower body 610 to rotationally decouple the upper body 610 from the lower body 620. The snap ring 618 secures the ring member 621 to the upper body 610 and prevents the ring member 621 from moving back into a position where the teeth members 659 re-engage the teeth member 629.

When the teeth members 659 on the ring member 621 are disengaged from the teeth members 629 on the lower body 620, rotation of the upper body 610 cannot be transmitted to the lower body 620 by the ring member 621. Rather, the upper body 610 can be rotated relative to the lower body 620. The upper section 605A of the work string can be rotated relative to the lower section 605B of the work string when the swivel 600 is actuated to the second operating position.

Other and further embodiments may be devised without departing from the basic scope thereof, and the scope thereof is determined by the claims that follow.

The invention claimed is:

1. A method of using a liner assembly, comprising:

inserting the liner assembly into a wellbore, wherein the liner assembly includes an annular packer and a port collar;

closing fluid flow through a lower end of the liner assembly;

actuating the annular packer into engagement with the wellbore;

actuating the port collar into an open position to open fluid communication between an interior of the liner assembly and the wellbore, wherein the port collar is actuated into the open position after the annular packer is actuated into engagement with the wellbore, and wherein the port collar is actuated into the open position using a coded pressure pulse;

pumping cement into an annulus of the wellbore surrounding the liner assembly through the port collar at a location above the annular packer;

actuating the port collar into a closed position to close fluid communication between the interior of the liner assembly and the wellbore;

actuating a swivel of the liner assembly to rotationally decouple an upper portion of the liner assembly from a lower portion of the liner assembly; and rotating the port collar while cement is pumped into the annulus of the wellbore surrounding the liner assembly, wherein the swivel is positioned below the port collar.

2. The method of claim 1, further comprising rotating the upper portion of the liner assembly above the swivel to help distribute cement within the annulus of the wellbore surrounding the liner assembly.

3. The method of claim 1, further comprising actuating the port collar into the closed position using at least one of a hydraulic, pneumatic, electric, and mechanical force.

4. The method of claim 1, further comprising actuating the port collar into the closed position using a radio frequency identification tag.

5. The method of claim 1, further comprising actuating a liner hanger of the liner assembly into engagement with the wellbore prior to pumping cement into the wellbore.

6. The method of claim 1, further comprising actuating a liner packer of the liner assembly into engagement with the wellbore after pumping cement into the wellbore.

7. The method of claim 1, wherein the liner assembly is used to drill the wellbore and then cemented within the wellbore in a single trip into the wellbore.

8. A method of using a liner assembly, comprising:

lowering the liner assembly into a wellbore, wherein the liner assembly includes an annular packer, an upper port collar, and a lower port collar;

actuating the annular packer into engagement with the wellbore;

actuating one of the upper and lower port collars into an open position to open fluid communication between an interior of the liner assembly and the wellbore, wherein the upper or lower port collar is actuated into the open position using a coded pressure pulse;

pumping cement into an annulus of the wellbore surrounding the liner assembly through the upper or lower port collar;

actuating the upper or lower port collar into a closed position to close fluid communication between the interior of the liner assembly and the wellbore;

actuating a swivel of the liner assembly to rotationally decouple an upper portion of the liner assembly from a lower portion of the liner assembly; and rotating at least one of the upper and lower port collars while cement is pumped into the annulus of the wellbore surrounding the liner assembly, wherein the swivel is positioned below at least one of the upper and lower port collars.

9. The method of claim 8, further comprising actuating the upper or lower port collar into the closed position using at least one of a hydraulic, pneumatic, electric, and mechanical force.

10. The method of claim 8, further comprising actuating the upper or lower port collar into the closed position using a radio frequency identification tag.

11. The method of claim 8, further comprising drilling the wellbore using the liner assembly.

12. The method of claim 8, wherein actuating one of the upper and lower port collars comprises actuating the upper port collar, and further comprising:

actuating the lower port collar into an open position to open fluid communication between the interior of the liner assembly and the wellbore;

pumping cement into the wellbore through the lower port collar; and actuating the lower port collar into a closed position to close fluid communication between the interior of the liner assembly and the wellbore.

13. The method of claim 12, further comprising actuating the lower port collar into the open position using at least one of a hydraulic, pneumatic, electric, and mechanical force.

14. The method of claim 12, further comprising actuating the lower port collar into the open position using a coded pressure pulse.

15. The method of claim 12, further comprising actuating the lower port collar into the closed position using at least one of a hydraulic, pneumatic, electric, and mechanical force.

16. The method of claim 12, further comprising actuating the lower port collar into the closed position using a radio frequency identification tag.

17. The method of claim 12, wherein the lower port collar is actuated into the open position and the closed position prior to actuating the upper port collar into the open position.

18. A liner assembly for use in a wellbore, comprising:

a liner hanger;

a liner packer positioned below the liner hanger;

a port collar positioned below the liner packer, wherein the port collar is movable between an open position that opens fluid communication between an interior of the liner assembly and an annulus surrounding the liner assembly, and a closed position that closes fluid communication between the interior of the liner assembly and the annulus surrounding the liner assembly, and wherein the port collar is actuated into the open position using a coded pressure pulse;

an annular packer positioned below the port collar, wherein the annular packer is configured to be actuated into engagement with the wellbore prior to the port collar being movable into the open position; and a swivel positioned above the annular packer and configured to rotationally decouple a portion of the liner assembly above the swivel from a portion of the liner assembly below the swivel, and wherein the swivel is positioned below the port collar such that the port collar can be rotated while cement is pumped into the annulus surrounding the liner assembly.

19. The assembly of claim 18, wherein the port collar is actuated into the closed position using at least one of a hydraulic, pneumatic, electric, and mechanical force.

20. The assembly of claim 18, wherein the port collar is actuated into the closed position using a radio frequency identification tag.

21. The assembly of claim 18, further comprising a running string, wherein the running string is releasable from the assembly when disposed within the wellbore.

22. The assembly of claim 18, further comprising a second port collar, wherein the second port collar is movable between an open position that opens fluid communication between the interior of the liner assembly and the annulus surrounding the liner assembly, and a closed position that closes fluid communication between the interior of the liner assembly and the annulus surrounding the liner assembly.

23. The assembly of claim 22, wherein the second port collar is actuated into the open position using a coded pressure pulse.

24. The assembly of claim 22, wherein the second port collar is actuated into the closed position using a radio frequency identification tag.

25. The assembly of claim 22, wherein the second port collar is positioned below the port collar.

* * * * *